US009580271B2

(12) United States Patent
Sorsa et al.

(10) Patent No.: US 9,580,271 B2
(45) Date of Patent: Feb. 28, 2017

(54) ELEVATOR SYSTEM CONFIGURED TO DECENTRALIZE ALLOCATION OF HALL CALLS

(71) Applicants: Janne Sorsa, Helsinki (FI); Marja-Liisa Siikonen, Helsinki (FI)

(72) Inventors: Janne Sorsa, Helsinki (FI); Marja-Liisa Siikonen, Helsinki (FI)

(73) Assignee: Kone Corporation, Helsinki (FI)

( * ) Notice: Subject to any disclaimer, the term of this patent is extended or adjusted under 35 U.S.C. 154(b) by 502 days.

(21) Appl. No.: 14/151,199

(22) Filed: Jan. 9, 2014

(65) Prior Publication Data

US 2014/0124302 A1 May 8, 2014

Related U.S. Application Data

(63) Continuation of application No. PCT/FI2012/050789, filed on Aug. 16, 2012.

(30) Foreign Application Priority Data

Aug. 26, 2011 (FI) ..... 20115828

(51) Int. Cl.
*B66B 1/18* (2006.01)
*B66B 1/24* (2006.01)

(52) U.S. Cl.
CPC ..... *B66B 1/2458* (2013.01); *B66B 1/2408* (2013.01); *B66B 2201/102* (2013.01);
(Continued)

(58) Field of Classification Search
CPC ..... B66B 1/2458; B66B 1/2408; B66B 2201/102; B66B 2201/103;
(Continued)

(56) References Cited

U.S. PATENT DOCUMENTS 5,229,559 A * 7/1993 Siikonen ..... B66B 1/2408 187/382
5,305,198 A 4/1994 Schroder et al.
(Continued)

FOREIGN PATENT DOCUMENTS

EP 0663366 A1 7/1995
EP 1195345 A1 4/2002
(Continued)

OTHER PUBLICATIONS

Extended European Search Report dated Feb. 27, 2015 issued in corresponding European Application No. 12826951.1.
(Continued)

*Primary Examiner* — Anthony Salata
(74) *Attorney, Agent, or Firm* — Harness, Dickey & Pierce, P.L.C.

(57) ABSTRACT

A method for allocating elevators in an elevator system, the elevator system including a group control system responsive to hall calls received from call input devices, and elevator-specific elevator controllers configured to control elevators based on commands issued by the group control system, wherein the method including generating a number of route alternatives based on calls active; calculating, by the elevator controllers, elevator-specific cost terms associated with the route alternatives; transmitting, by the elevator controllers, the cost terms to the group control system; and allocating, by the group control system, the hall calls to the elevators according to the route alternative giving the lowest allocation cost.

14 Claims, 3 Drawing Sheets

(52) U.S. Cl.
CPC ... *B66B 2201/103* (2013.01); *B66B 2201/211* (2013.01); *B66B 2201/212* (2013.01); *B66B 2201/216* (2013.01); *B66B 2201/40* (2013.01)

(58) Field of Classification Search
CPC ..... B66B 2201/211; B66B 2201/212; B66B 2201/216; B66B 2201/40
USPC ..... 187/247, 380–389, 391, 396
See application file for complete search history.

(56) References Cited

U.S. PATENT DOCUMENTS

| | | | | |
|---|---|---|---|---|
| 5,306,878 | A | 4/1994 | Kubo | |
| 5,932,852 | A * | 8/1999 | Tyni | B66B 1/2458 187/247 |
| 6,237,721 | B1 | 5/2001 | Siikonen | |
| 6,655,501 | B2 * | 12/2003 | Kostka | B66B 1/2458 187/247 |
| 6,945,365 | B2 * | 9/2005 | Matela | B66B 1/20 187/247 |
| 7,117,980 | B2 * | 10/2006 | Wyss | B66B 1/18 187/247 |
| 7,128,190 | B2 * | 10/2006 | Kostka | B66B 1/20 187/247 |
| 7,546,906 | B2 * | 6/2009 | Tyni | B66B 1/2458 187/247 |
| 7,694,781 | B2 * | 4/2010 | Sorsa | B66B 1/2458 187/382 |
| 7,743,890 | B2 * | 6/2010 | Nikovski | B66B 1/2458 187/247 |
| 8,205,722 | B2 * | 6/2012 | Suihkonen | B66B 1/2458 187/383 |
| 9,126,806 | B2 * | 9/2015 | Joyce | B66B 1/2458 |
| 9,302,885 | B2 * | 4/2016 | Christy | B66B 1/2408 |
| 2001/0002636 | A1 | 6/2001 | Siikonen | |
| 2006/0243536 | A1 | 11/2006 | Tyni et al. | |
| 2008/0105499 | A1 | 5/2008 | Tyni et al. | |
| 2009/0159374 | A1 | 6/2009 | Sorsa et al. | |
| 2011/0214948 | A1 | 9/2011 | Suihkonen et al. | |

FOREIGN PATENT DOCUMENTS

| | | | |
|---|---|---|---|
| GB | 2237663 | A | 5/1991 |
| WO | WO-9921787 | A1 | 5/1999 |
| WO | WO 2005/042389 | A1 | 5/2005 |
| WO | WO-2010046522 | A1 | 4/2010 |

OTHER PUBLICATIONS

Finnish Search Report for FI20115828 dated Jan. 1, 2012.
International Search Report for PCT/FI2012/050789 dated Nov. 16, 2012.
Written Opinion for PCT/F12012/050789 dated Nov. 16, 2012.

* cited by examiner

ELEVATOR SYSTEM CONFIGURED TO DECENTRALIZE ALLOCATION OF HALL CALLS

This application is a continuation of PCT International Application No. PCT/FI2012/050789 which has an International filing date of Aug. 16, 2012, and which claims priority to Finnish patent application number 20115828 filed Aug. 26, 2011, the entire contents of both which are incorporated herein by reference.

FIELD OF THE INVENTION

The present invention relates to elevator systems. In particular, the invention relates to a method and an elevator system in which allocation calculation is distributed between several different control units in the elevator system.

BACKGROUND OF THE INVENTION

High-rise buildings are usually provided with numerous elevators, escalators and other corresponding transport facilities for carrying passengers between different floors. When passengers input elevator calls at floor landings, the elevator group control system allocates elevators (elevator cars) to the passengers on the basis of desired optimization criteria. In an ordinary elevator system, call input is effected using up/down buttons located in elevator lobbies, by means of which the passenger calls an elevator and at the same time indicates the intended traveling direction. Upon arrival of the elevator car at the call input floor, the passenger enters the car and indicates his/her destination floor by means of destination floor buttons provided in the elevator car. However, the above-described call input method is impractical and often inefficient, which is why call input in elevator systems is increasingly implemented using so-called destination call systems, in which each passenger indicates the intended destination floor already at the departure floor, e.g. in the entrance hall, before entering an elevator car. Destination calls are input via a specific destination call terminal using either buttons or an electrically readable identifier. In destination call systems, an allocation decision is generally made immediately upon registration of the call. In traditional elevator systems, in which a call is input using up/down buttons, the allocation decision can be delayed up to a moment when there still remains enough time for the allocated elevator to stop at the call input floor.

The calls input by passengers are thus generally registered in the group control system of the elevator bank, which allocates to the passenger an elevator that best meets the given optimization criteria. Based on the allocation result, the group control system sends the required commands to the elevator controller of the allocated elevator for picking up the passenger from the departure floor and transporting the passenger to the destination floor chosen by the passenger. If the passengers are using an elevator bank consisting of a large number of elevators, e.g. more than eight elevators, the allocation calculation will be a highly calculation-intensive optimization task. Therefore, in the case of prior-art elevator banks in which the allocation task is solved in the group control system of the elevator bank, an optimal allocation result can not necessarily be reached due to lack of time and/or the calculation takes an immoderately long time. There is thus a need for a solution in which the calculation load can be reduced by decentralizing the calculation of optimal elevator routes within the elevator system.

OBJECT OF THE INVENTION

The object of the present invention is to eliminate or at least to alleviate the above-described drawbacks encountered in prior-art solutions. A further object of the invention is to achieve one or more of the following aims:

- a solution that will allow large elevator systems to be implemented using standard group control arrangements or comparable control systems;
- a solution that will improve the transport capacity of an elevator system and reduce the traveling times;
- a solution that will simplify group control by reducing the calculation workload spent by the group control system on allocation calculation.

BRIEF DESCRIPTION OF THE INVENTION

Example embodiments of the invention are characterized by what is disclosed in the claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of ad-vantages achieved. In this case, some of the attributes contained in the claims below may be superfluous from the point of view of separate inventive concepts. The features of different embodiments of the invention can be applied in connection with other embodiments within the scope of the basic inventive concept.

The meanings of certain terms used in connection with this subject matter are defined below:

- cost function: elevator-specific cost associated with the serving of one or more calls, e.g. the waiting time, traveling time or energy consumption associated with the call, or an appropriate combination of these;
- allocation cost: the total cost associated with the serving of calls active, calculated using a desired cost function. In the cost function, one or more elevator-specific cost terms are used, from which a sum weighted by desired weighting coefficients can be calculated. The allocation cost describes the ability of the elevators to serve passengers having issued a call so as to achieve desired optimization objectives;
- elevator route: consists of the floor where the elevator is currently located and the floors at which the elevator is to stop according to the calls allocated for it;
- hall call: a destination call issued from a floor or an elevator call entered via up/down buttons.

The basic idea of the invention is to distribute at least part of the allocation calculation task between the group control system and the elevator control systems.

The present invention discloses a method for allocating hall calls in an elevator system, which comprises call input devices for registering hall calls at the floors, a group control system responsive to said hall calls, and a number of elevators controlled by elevator-specific elevator controllers on the basis of commands issued by the group control system. According to the invention, a number of route alternatives are generated on the basis of the calls active, and allocation calculation is decentralized by calculating the elevator-specific cost terms associated with the route alternatives in the elevator controllers. The cost terms are returned to the group control system, which allocates the hall calls to the elevators according to the route alternative giving the lowest allocation cost.

The present invention also discloses an elevator system, which comprises a number of elevators, at least one group control system, call input devices located at the floors and connected to the group control system, and elevator-specific elevator controllers. The elevator control system is arranged to register hall calls issued through the call input devices, to generate a number of route alternatives based on calls active; to transmit to the elevator controllers elevator-specific route data corresponding to the route alternatives; to read elevator-specific cost terms associated with the routes and calculated by the elevator controllers; and to allocate the hall calls to the elevators according to the route alternative giving the lowest allocation cost.

In this connection, "hall call" refers both to a traditional call entered by means of up/down buttons and to a destination call entered through a destination call terminal. If a hall call is a destination call, then the call comprises information indicating both the departure floor and the destination floor of the passenger. If a hall call is a call entered using up/down buttons, then the call comprises information indicating the passenger's departure floor and traveling direction. The elevator system may have call input devices of different types at different floors, for example so that destination call terminals are used at floors subject to congestion while up/down buttons are used at other floors.

In an embodiment of the invention, allocation calculation is repeated at desired intervals, and the decision as to which elevator is to serve a call is made after input of the call before arrival of the elevator at the call input floor. By virtue of this embodiment, more frequent/numerous repetitions of the calculation-intensive calculation task can be effected than before and the moment of making an allocation decision can be delayed more optimally than before as compared to centralized calculation. This solution is particularly applicable in cases where a hall call is entered using up/down buttons.

In an embodiment of the invention, information indicating the elevator allocated to the passenger and/or its current location is provided to the passenger immediately in connection with call input. The information can be presented via guidance means provided in conjunction with the call input device. By virtue of this embodiment, the passenger is quickly informed as to the elevator serving him/her even in large elevator systems, thus facilitating call input and e.g. reducing the build-up of queues in front of call input devices. This solution is particularly applicable in cases where the call input device is a destination call terminal and the elevator system comprises a plurality of elevator groups.

An elevator system according to the invention can also be formed by interconnecting the group control systems of several elevator groups using a suitable data transfer connection. In this case, each elevator group has its own call input devices, which are connected to the group control system of the elevator group over a suitable device bus. The group control system registering the hall call given by a passenger transmits the call data both to the group control systems of its own group and to the group control systems of the other groups. In response to the call data, the group control system receives elevator-specific cost terms, on the basis of which the group control system allocates an elevator for use by the passenger and guides the passenger to the elevator allocated and, if necessary, to the relevant elevator bank. This embodiment makes it possible to easily implement even large elevator systems, in which the transport capacity can be equalized between different elevator groups. The transmission of call data between the elevator groups can be activated on the basis of a desired service criterion. For example, if the average waiting time in an elevator group exceeds a given threshold value, then transmission of call data to one or more other elevator groups (group control systems) is activated, but otherwise the elevator to serve the passenger is allocated from the elevator group in which the call was registered.

In an embodiment of the invention, a constant number of cost terms are always calculated by the elevator controllers, but the number and weighting of the cost terms to be used in the cost function in the allocation calculation are varied dynamically so as to achieve the optimization target desired in each case. In this embodiment, the elevator controllers thus calculate all cost terms, of which a desired set of cost terms is used, e.g. on the basis of the traffic situation prevailing in the elevator group, for the making of allocation decisions. This embodiment allows the elevator system to dynamically adapt itself to achieve different optimization targets while at the same time the group control systems can be implemented as "standard control systems", in which the number of cost terms to be calculated is constant.

The solution according to the present invention provides several advantages as compared to prior-art solutions. One of the advantages of the present invention is that allocation calculation and other data processing can be distributed in the elevator system between several different computing units, with the result that the solution is simple and efficient in respect of computation capacity. The elevator system of the invention can be implemented using constant-function standard control systems, from which it is easy to create, e.g. by parametrizing, an elevator system that will achieve the desired service targets. Using this solution, even large elevator systems can be easily implemented, because the computation capacity available for allocation calculation is increased in proportion to the number of elevators. Thus, faster allocation calculation is achieved while at the same time the accuracy of the cost terms used in allocation calculation is improved. The accuracy of the cost terms is also significantly improved due to the fact that they are calculated by the elevator controllers, which generally have accurate information regarding the state and mode of behavior (door times, running speeds, etc.) of the elevator to be controlled.

LIST OF FIGURES

In the following, the invention will be described in detail by referring to embodiment examples, wherein FIG. 1 represents an elevator system according to the invention;

BRIEF DESCRIPTION OF THE INVENTION

Figure 1:
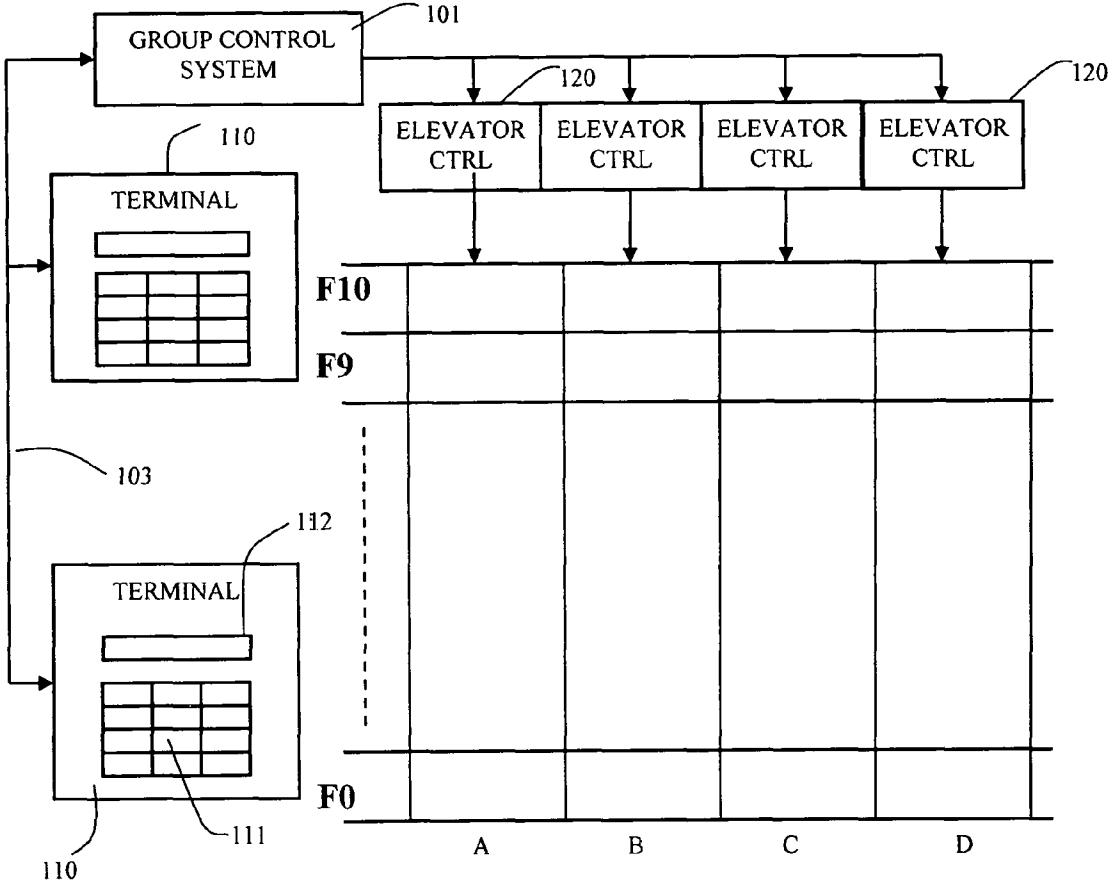

FIG. 1 represents an elevator group which comprises four elevators A, B, C and D. The elevators in the elevator group serve building floors F0-F10. Installed at the floors are destination call terminals 110, which are connected over a device bus 103 to the group control system 101. Instead of destination call terminals, the call input devices used may also be traditional up/down buttons (not shown in FIG. 1). The number and disposition of the call input devices at the floors can be selected separately in each case; for example, an extra destination call terminal may be placed in the entrance lobby near the entrance door, thus allowing the passenger to give a destination call in good time before arriving at the elevators. Each elevator is controlled by an elevator controller 120 based on commands sent by the group control system 101.

When a passenger gives a destination call through a destination call terminal 110, the group control system registers the passenger's departure floor (the floor at which the call was input) and destination floor (the floor to which the passenger is going). The group control system generates from active calls a number of route alternatives and transmits corresponding elevator-specific route data to the relevant elevator controllers 120. The elevator controllers calculate the cost terms associated with the elevator-specific routes on the basis of the route data and elevator status data and return the cost terms to the group control system 101. Based on the cost terms, the group control system calculates the total cost of each route alternative and allocates the calls to the elevators according to the route alternative giving the lowest total cost. Elevator status data include e.g. the floor at which the elevator is currently located, number of passengers in the elevator car, calls to be served by the elevator, traveling direction. Moreover, the elevator controllers have information regarding the door times of the elevator to be controlled, the running times between floors, and other parameters needed for the calculation of cost terms. "Cost term" refers e.g. to the waiting time, travel time, energy consumption or other corresponding cost incurred if the calls included in the route alternative were to be served by the elevator in question.

According to an embodiment of the invention, each elevator controller 120 always calculates a predetermined number of cost terms, of which only those cost terms which are needed in allocation calculation are used by the group control system. The number and weighting of the cost terms used in the cost function can be dynamically changed by the group control system e.g. based on the time of the day or the traffic situation prevailing in the elevator group.

Utilizing the cost terms, the group control system 101 thus calculates the allocation costs associated with the route alternatives and allocates the calls to the elevators in such a way that the allocation cost is minimized. The allocation costs can be calculated by applying allocation methods known in themselves, in which methods one or more aforesaid elevator-specific cost terms are taken into account.

If the hall call registered is a destination call, then an elevator is allocated immediately. The passenger having entered the call is informed by visual or auditory means about the elevator and, if necessary, its current location via guidance means 112 provided in conjunction with the destination call terminal. If the hall call registered is a call entered using up/down buttons, then the group control system will keep repeating the above-described allocation calculation e.g. at 0.3 second intervals until the desired termination criterion is met and the group control system makes a decision regarding the elevator (assigns an elevator) to serve the call. The above-mentioned calculation time is only given by way of example and may be longer or shorter than this, depending on the application. The aforesaid termination criterion is e.g. that the time remaining for the elevator consistent with the allocation result to reach the deceleration point corresponding to the call input floor is sufficiently short.

Figure 2:
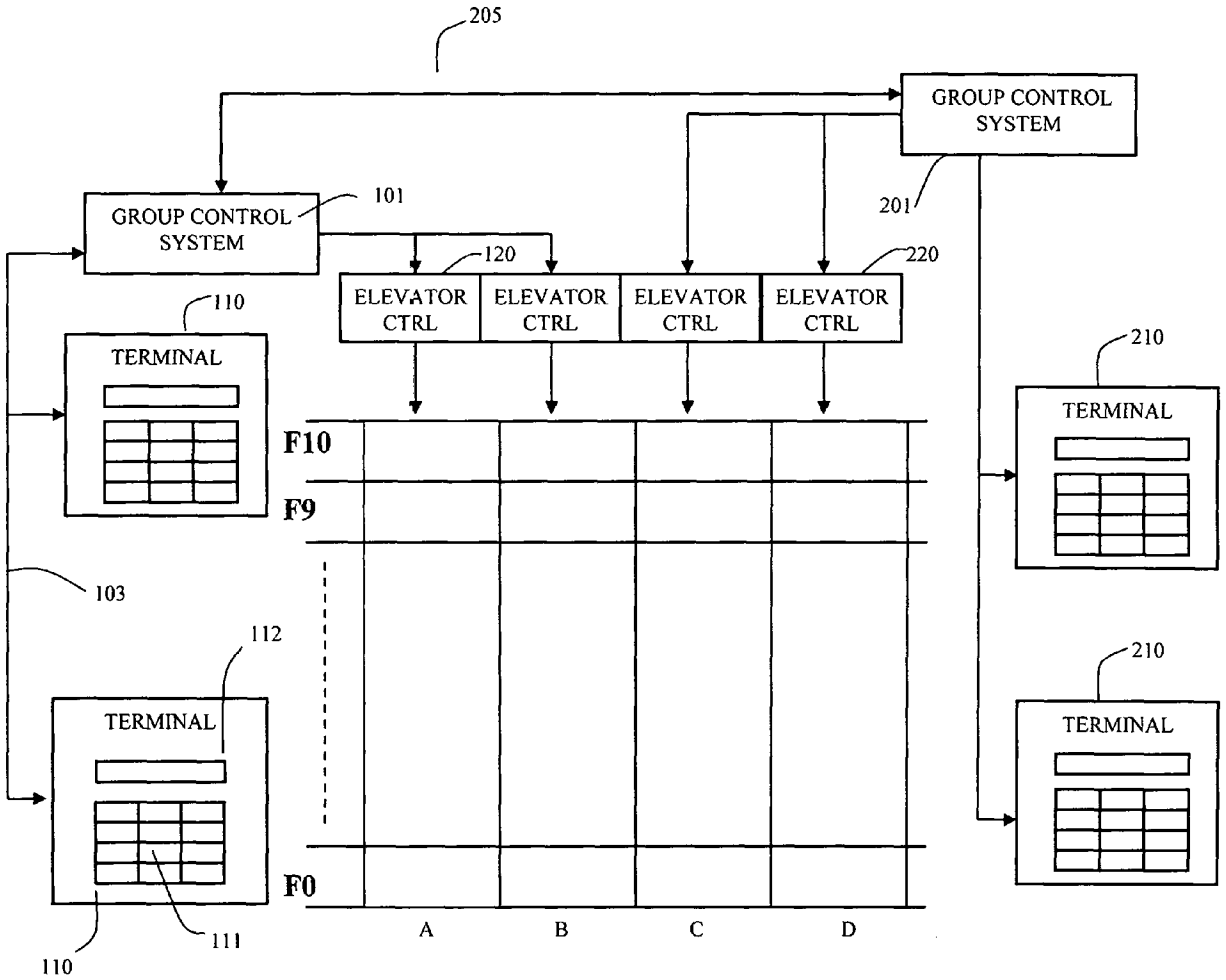
FIG. 2 represents a second elevator system according to the invention.

FIG. 2 presents by way of example another elevator system according to the invention, comprising two elevator groups X and Y. Elevator group X comprises elevators A and B, which are controlled by elevator controllers 120 on the basis of commands sent by group control system 101. Elevator group Y comprises elevators C and D, which are controlled by elevator controllers 220 on the basis of commands sent by group control system 201. All the elevators can serve building floors F0-F10. Mounted at the floor landings are destination call terminals 110 and 210, and of these, destination call terminals 110 are connected over device bus 103 to group control system 101 while destination call terminals 210 are connected over device bus 203 to group control system 201. The group control systems 101 and 201 are interconnected via a data transfer bus 205 applicable for transmitting data between the group control systems.

If a passenger gives a destination call e.g. from the entrance lobby using destination call terminal 110, the group control system 101 of elevator group X will register the destination call and transmit the call data to group control system 201. Elevator controllers 120 calculate elevator-specific cost terms and return them to group control system 101 as explained above. Elevator controllers 220 calculate corresponding cost terms and send them to group control system 201, which transmits them further to group control system 101 via data transfer bus 205. When group control system 101 has the cost terms for all the elevators A, B, C and D, it allocates the best elevator from either elevator group on the basis of the cost terms. The passenger is informed via the guiding means 112 of the destination call terminal 110 about the elevator and/or elevator group allocated. Similarly, if a passenger gives a destination call using a destination call terminal 210 of elevator group Y, a decision regarding the elevator to be allocated will be made by group control system 201 in a corresponding manner, as described in the above example.

In the elevator system illustrated in FIG. 2, the decision to transmit the call data from one group control system to the other may be based on a desired service criterion. For example, if in elevator group X the average waiting time exceeds a given threshold value, then group control system 101 will activate transmission of call data to group control system 201 to equalize the transport capacity between the elevator groups X and Y. In quiet traffic conditions, each elevator group can work independently, in which case it is e.g. easier for the passenger to get to the elevator serving him/her. As explained above, in the destination floor control system, each call is allocated only once and assigned immediately to that elevator which optimizes the allocation cost calculated by the cost function.

Figure 3:
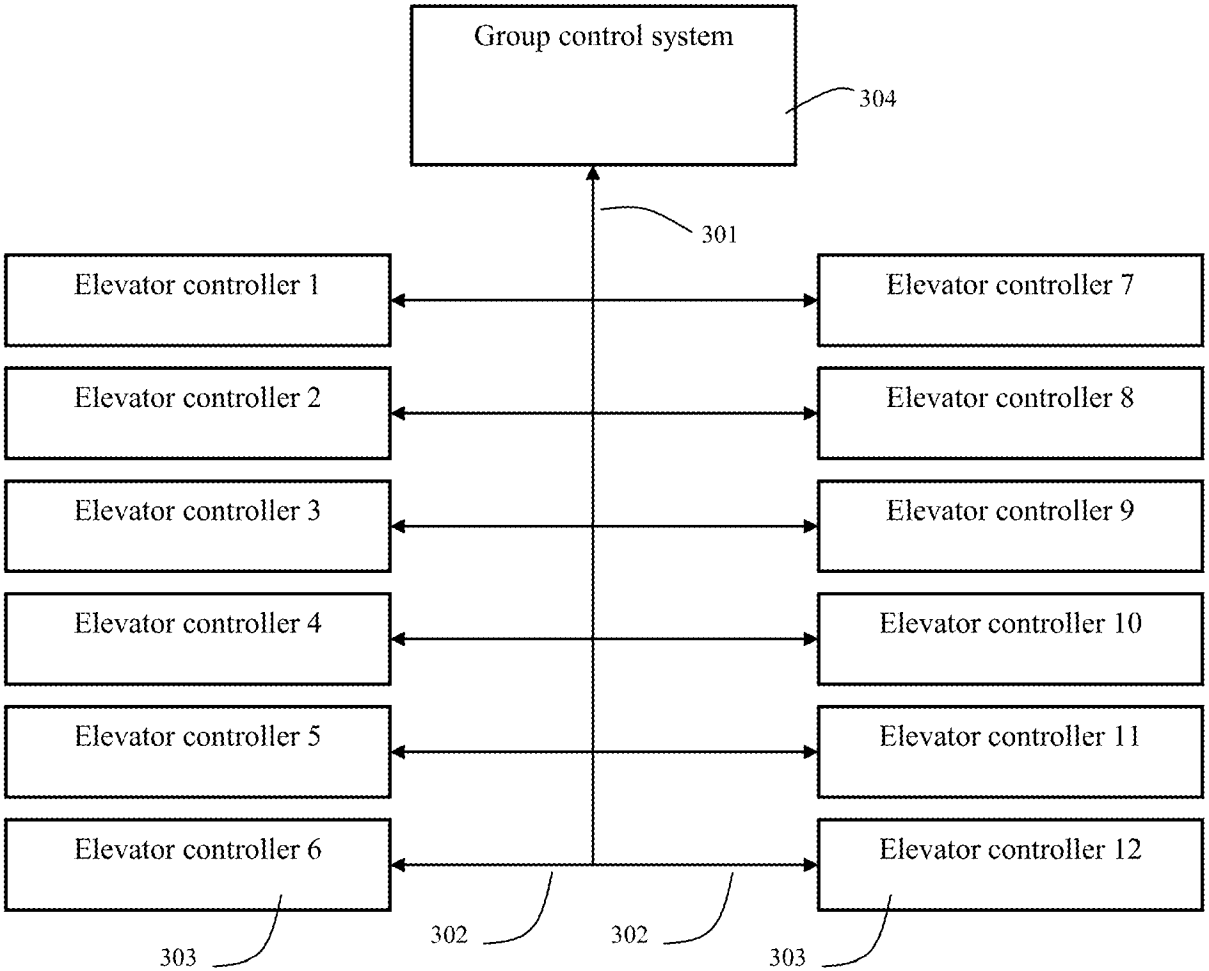
FIG. 3 illustrates the distribution of allocation calculation between elevator controllers and the making of a final allocation decision in the group control system.

FIG. 3 illustrates by way of example the distribution of allocation calculation between elevator controllers 303 (elevator controllers 1-12) and the making of a final allocation decision in the group control system 304. Reference number 302 denotes elevator-specific route data, which are generated on the basis of the calls active and sent to the elevator controllers 303 by the group control system. The elevator controllers calculate the elevator-specific cost terms associated with the routes and return them to the group control system (indicated by reference number 301 in FIG. 3). The group control system calculates the allocation costs of the route alternatives and allocates the calls to the elevators in such a way that the desired cost function is minimized.

It is obvious to a person skilled in the art that different embodiments of the invention are not exclusively limited to the examples described above, but that they may be varied within the scope of the claims presented below.

The invention claimed is:

1. A method for allocating elevators by at least one group control system in an elevator system, the elevator system including the at least one group control system and elevator-specific elevator controllers configured to control elevators based on commands issued by the at least one group control system, wherein the method comprises:

registering hall calls entered using the call input devices;

generating a number of route alternatives based on active ones of the hall calls;

receiving elevator specific cost terms from the elevator controllers, the elevator-specific cost terms being associated with the route alternatives; and allocating the hall calls to the elevators according to the route alternative giving the lowest allocation cost by, determining which ones of the hall calls are traditional calls received from an up/down input device and which ones of the hall calls are destination calls received from a destination call terminal, allocating the destination calls based on the route alternative giving the lowest allocation cost without delaying the allocating of the destination calls, and delaying allocating the traditional calls by instructing the elevator controllers to recalculate the cost terms associated with the traditional calls as the elevator giving the lowest allocation cost approaches a call input floor associated with the up/down input device.

2. The method according to claim 1, wherein the method further comprises:

instructing the elevator controllers to recalculate the cost terms at desired intervals; and deciding which one of the elevators is to serve a respective one of the hall calls after input of the call before arrival of the elevator to be allocated at the call input floor.

3. The method according to claim 1, wherein the method further comprises:

allocating one of the elevators to serve a hall call in connection with call input such that the one of the elevators allocated to the passenger and its location are immediately indicated through a guidance device provided in conjunction with the call input device.

4. The method according to claim 1, wherein the at least one group control system includes a plurality of group control systems, and the method further comprises:

interconnecting the plurality of group control systems of different elevator groups via a data transfer connection;

transmitting the call data from a first group control system of the plurality of group control systems having received a call to a second group control system of the plurality of group control systems, the first group control system associated with a first elevator group and the second group control system associated with a second elevator group;

receiving from the second group control system the elevator-specific cost terms calculated for the elevators of the second elevator group; and taking the said cost terms into account to allocate an elevator to serve the passenger from any one of the first elevator group the second elevator group.

5. The method according to claim 4, wherein the transmission of call data to the plurality of group control systems is activated dynamically based on a desired service criterion.

6. The method according to claim 1, wherein the number of cost terms used in allocation is selected dynamically based on a desired service criterion.

7. An elevator system, comprising a number of elevators;

call input devices each associated with different floors, the call input devices configured to receive hall calls; and elevator-specific elevator controllers configured to control the elevators based on commands; and at least one group control system configured to, register hall calls entered using the call input devices, generate a number of route alternatives based on active ones of the hall calls, transmit to the elevator controllers elevator-specific route data corresponding to the route alternatives, receive, from the elevator controllers, elevator-specific cost terms associated with the routes, and allocate the hall calls to the elevators according to the route alternative giving the lowest allocation cost.

8. The elevator system according to claim 7, wherein the group control system is configured to, repeat allocation calculation at desired intervals, and to decide on the elevator to be allocated after call input before arrival of the elevator to be allocated at the call input floor.

9. The elevator system according to claim 7, further comprising:

a guidance device configured to guide the passenger to the allocated elevator and/or elevator group.

10. The elevator system according to claim 7, wherein the at least one group control system includes a plurality of group control systems interconnected by a data transfer bus, the plurality of group control systems associated with different elevator groups, and a first group control system of the plurality of group control systems is configured to, transmit call data to a second group control system of the plurality of group control systems, the first group control system associated with a first elevator group and the second group control system associated with a second elevator group, receive from the second group control system the elevator-specific cost terms calculated for the elevators of the second elevator group, and allocate elevators from any one of the first elevator group and the second elevator group based on said cost terms.

11. The elevator system according to claim 10, wherein the first group control system is configured to, activate the transmission of call data to the second group control system dynamically based on a given service criterion.

12. The elevator system according to claim 7, wherein the at least one group control system is configured to select the number of cost terms dynamically based on a desired service criterion.

13. The method according to claim 6, wherein the method further comprises:

varying, by the group control system, the number of cost terms based on one or more of a time of day and elevator traffic.

14. The elevator system according to claim 12, wherein the at least one group control system is configured to vary the number of cost terms based on one or more of a time of day and elevator traffic.

* * * * *